US009873064B1

(12) United States Patent
Adkins et al.

(10) Patent No.: US 9,873,064 B1
(45) Date of Patent: Jan. 23, 2018

(54) FLYING DISC WITH PROTECTED ELECTRONICS

(71) Applicant: Tucker International LLC, Hamilton Township, NJ (US)

(72) Inventors: Mark A. Adkins, East Brunswick, NJ (US); Jack S. Lovewell, Kunkletown, PA (US); Byron Hu, Guangdong (CN)

(73) Assignee: Tucker International, LLC, Hamilton Township, NJ (US)

( * ) Notice: Subject to any disclaimer, the term of this patent is extended or adjusted under 35 U.S.C. 154(b) by 0 days.

(21) Appl. No.: 15/277,038

(22) Filed: Sep. 27, 2016

(51) Int. Cl.
*A63H 33/18* (2006.01)
*A63H 5/00* (2006.01)
*H04R 1/02* (2006.01)

(52) U.S. Cl.
CPC ..... *A63H 33/185* (2013.01); *A63H 5/00* (2013.01); *A63H 33/18* (2013.01); *H04R 1/028* (2013.01)

(58) Field of Classification Search
CPC ..... A63H 27/00; A63H 33/18; A63B 65/10; A63F 9/02
See application file for complete search history.

(56) References Cited

U.S. PATENT DOCUMENTS 3,798,834 A * 3/1974 Samuel ..... A63H 33/18 362/802
4,045,029 A * 8/1977 Katzmark ..... A63H 33/18 473/589
4,889,347 A * 12/1989 Mineart ..... A63H 33/18 473/588
5,319,531 A * 6/1994 Kutnyak ..... A63H 33/18 362/184
5,895,308 A * 4/1999 Spector ..... A63H 5/00 446/183
8,021,209 B1 * 9/2011 Adkins ..... A63H 33/30 446/473
D765,188 S * 8/2016 LaRussa ..... D21/444
2003/0222404 A1 * 12/2003 Estrada ..... A63H 5/00 273/440
2005/0009435 A1 * 1/2005 Chan ..... A63H 33/18 446/46
2005/0170744 A1 * 8/2005 Smith ..... A63H 33/006 446/297
2006/0183576 A1 * 8/2006 Lindsey ..... A63H 33/18 473/570

(Continued)

*Primary Examiner* — Gene Kim
*Assistant Examiner* — Alyssa Hylinski
(74) *Attorney, Agent, or Firm* — LaMorte & Associates, P.C.

(57) ABSTRACT

A flying disc assembly that contains an electronics module. The electronics module is protected from impact forces by the structure of the flying disc assembly. The flying disc assembly includes an annular disc body that defines a central opening. The electronics module extends through the central opening and is joined to the annular disc body by shock absorbing elements. The shock absorbing elements enable the electronics module to move relative the annular disc body when the flying disc assembly experiences a rapid change in velocity. The range of movement is limited to prevent permanent deformation of the shock absorbing elements. However, the range of movement that is permitted significantly reduces the forces that are experienced by the electronics module.

18 Claims, 7 Drawing Sheets

(56) References Cited

U.S. PATENT DOCUMENTS

| | | | | |
|---|---|---|---|---|
| 2006/0205544 | A1* | 9/2006 | Wyner | A63B 41/00 473/569 |
| 2010/0020978 | A1 | 1/2010 | Garudadri et al. | |
| 2011/0053716 | A1 | 3/2011 | Lewis | |
| 2011/0250819 | A1* | 10/2011 | Tashman | A63H 33/18 446/46 |
| 2013/0303314 | A1 | 11/2013 | Tackett | |
| 2015/0201262 | A1 | 7/2015 | Ballbach | |
| 2015/0217922 | A1* | 8/2015 | Houvener | A45C 11/00 206/592 |
| 2015/0360138 | A1* | 12/2015 | Dawson | A63H 33/18 446/47 |

* cited by examiner

FLYING DISC WITH PROTECTED ELECTRONICS

BACKGROUND OF THE INVENTION

1. Field of the Invention

In general, the present invention relates to flying discs of the type that are thrown and caught for fun. More particularly, the present invention relates to flying discs that contain electronic modules that travel with the flying discs as they are thrown and caught.

2. Prior Art Description

Flying discs have been a successful toy product in the American marketplace for decades. Although some flying discs are used in playing sports, such as Frisbee® Golf and Ultimate Frisbee®, most flying discs are just thrown and caught for fun. As such, flying discs tend to be used when people are leisurely playing in an open outdoor environment.

When playing in an open outdoor environment, people often relax, drink beverages, eat food and listen to music. When playing with the flying disc, the activity typically causes the food and drink to be set aside. The music, however, can still play on. The problem is that if people spread far apart to throw and catch the flying disc, some of the people playing may travel outside of the music's range. Thus, not everyone who wants to listen to the music can hear it well.

In U.S. Patent Application Publication No. 2015/0201262 to Balbach, a flying disc is provided that plays music. The music is wirelessly transmitted to the flying disc from a cell phone or other such mobile computing device. A problem inherent with the Balbach design is one of reliability. Electronic components are delicate. When playing with a flying discs, the flying disc experiences significant forces that can compromise the electronics. A flying disc can have a forward velocity of over fifty miles per hour and a rotational speed of several revolutions per second. These velocities create annular momentum forces and centrifugal forces that are experienced by the electronics carried within the flying disc. Furthermore, the various velocities create significant G-forces when the flying disc is suddenly caught or impacted against a hard surface. These deceleration forces are also transferred to the electronics within the flying disc. The forces are significant enough to displace batteries, cause surface mounted components to separate from circuit boards and cause wires to detach from connectors. Accordingly, although electronics modules have been added to flying discs in the prior art, such electronics modules are easily damaged and result in products that have short functional life spans.

A need therefore exists for a flying disc that contains an electronics module yet is capable of protecting the electronics module in a manner that diminishes acceleration forces experienced by the electronics module. This need is met by the present invention as described and claimed below.

SUMMARY OF THE INVENTION

The present invention is a flying disc assembly that contains an electronics module. The electronics module is thrown and caught with the flying disc assembly and is protected from impact forces by the structure of the flying disc assembly. The structure of the flying disc assembly includes an annular disc body that defines a central opening. The electronics module extends through the central opening. The electronics module is joined to the annular disc body by shock absorbing elements that interconnect the electronics module to the annular disc body within the central opening. The shock absorbing elements enable the electronics module to move relative to the annular disc body when the flying disc assembly experiences a rapid change in velocity. The range of movement is limited to prevent permanent deformation of the shock absorbing elements. However, the range of movement that is permitted significantly reduces the forces that are experienced by the electronics module when the flying disc assembly is impacted. This prolongs the life of the electronics module.

The electronics module streams audio that is wirelessly transmitted from a remote source, such as a cell phone. In this manner, the flying disc assembly is able to broadcast music and other audio content as it is thrown and caught.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention flying disc assembly can be embodied in many ways, two embodiments of the flying disc assembly are illustrated and described. The illustrated embodiments are selected in order to set forth some of the best modes contemplated for the invention. The illustrated embodiments, however, are merely exemplary and should not be considered limitations when interpreting the scope of the appended claims.

Figure 1:
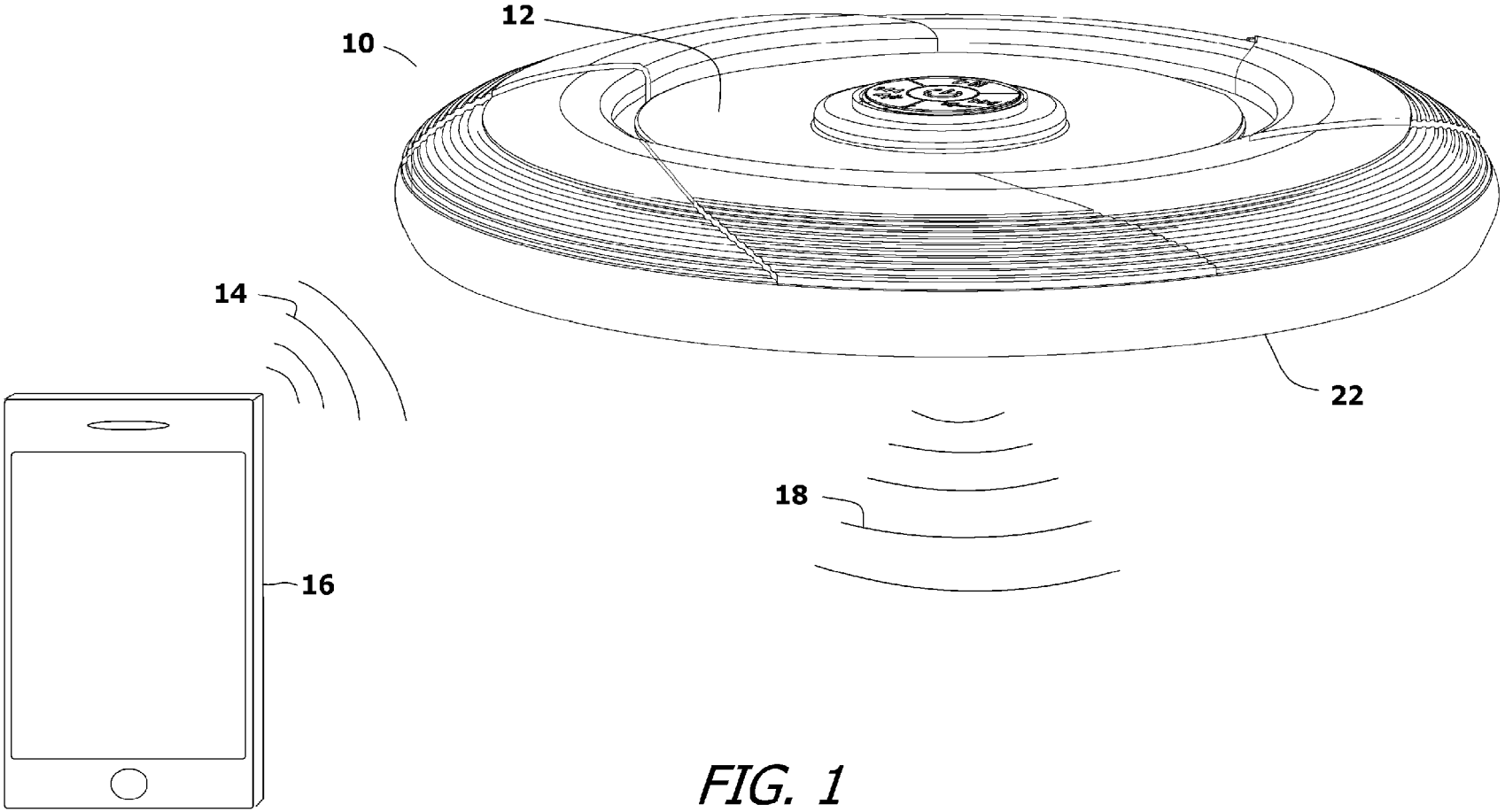
FIG. 1 is a perspective view of an exemplary embodiment of a flying disc assembly shown in conjunction with a remote computing device.
Figure 2:
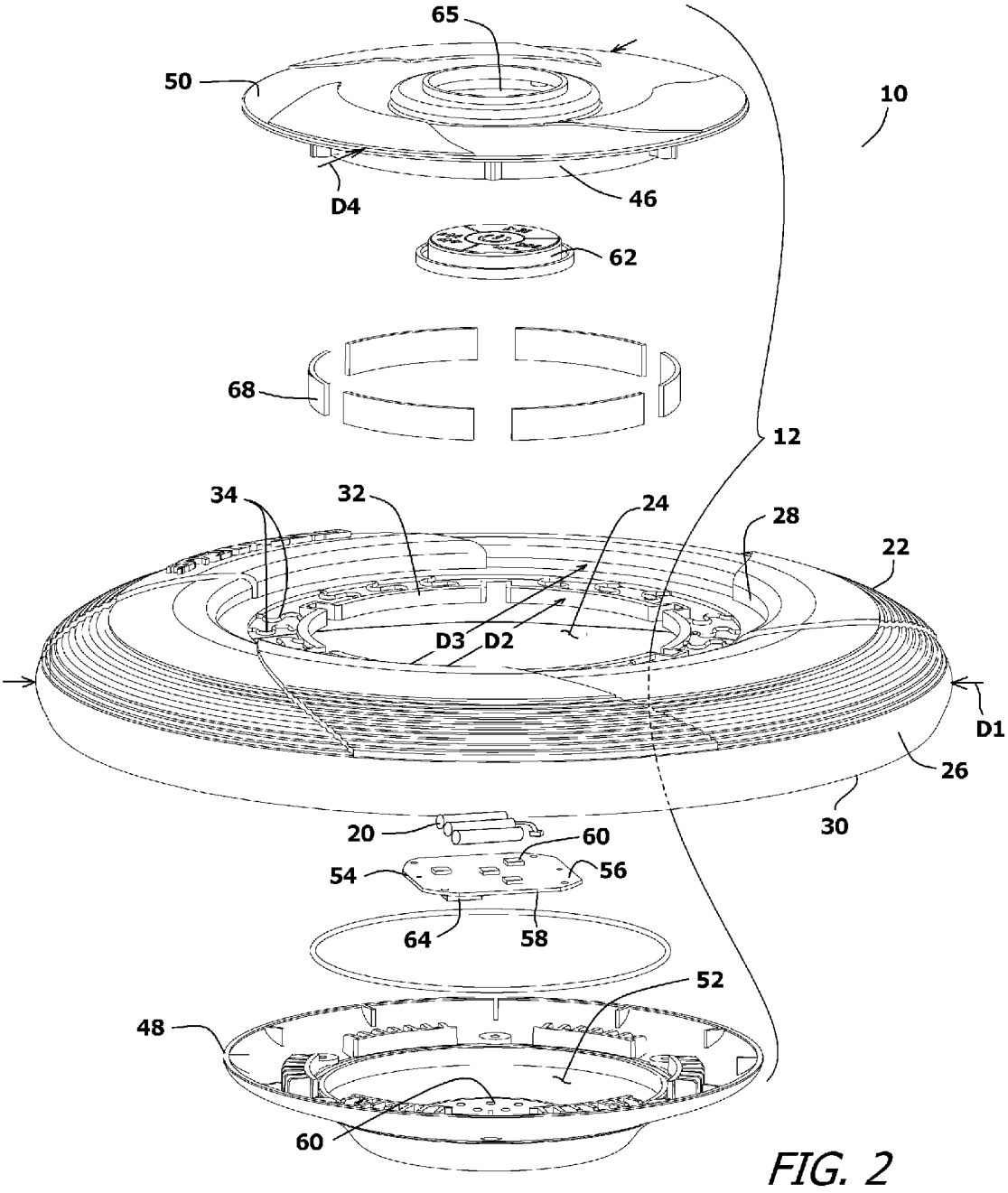
FIG. 2 is an exploded view of the flying disc assembly shown in FIG. 1.

Referring to FIG. 1 and FIG. 2, it can be seen that a flying disc assembly 10 is provided that is capable of being thrown and caught in the traditional manner. The flying disc assembly 10 is also capable of transmitting audio signals, such as music, as the flying disc assembly 10 is being thrown and caught. This is accomplished by mounting an electronics module 12 into the structure of the flying disc assembly 10. As will be explained, the electronics module 12 includes the circuitry required to receive wireless data transmissions 14 from a remote portable computing device 16. The data transmission 14 stream to the electronics module 12 and are converted into audio signals 18. The audio signals 18 are broadcast aloud from the electronics module 12.

The electronics module 12 is powered by batteries 20, which can be standard or rechargeable. The batteries 20 and the electronics within the electronics module 12 are protected from potentially destructive acceleration forces by the structure of the flying disc assembly 10.

The flying disc assembly 10 has an annular disc body 22. The annular disc body 22 defines and surrounds a central opening 24. As such, the annular disc body 22 has an outside diameter D1 across a continuous circular outside periphery 26 and an inside diameter D2 across the central opening 24. A circular ridge 28 is formed on the annular disc body 22 that is inset from the central opening 24. As such, the circular ridge 28 has a diameter D3 that is larger than the diameter D2 of the central opening 24 but smaller than the outside diameter D1 of the outside periphery 26.

The annular disc body 22 is either molded or vacuum formed from plastic. The annular disc body 22 curves as it approaches the outside periphery 26, therein creating a curved lip 30 that assists in the grasping, throwing and catching of the flying disc assembly 10.

Figure 3:
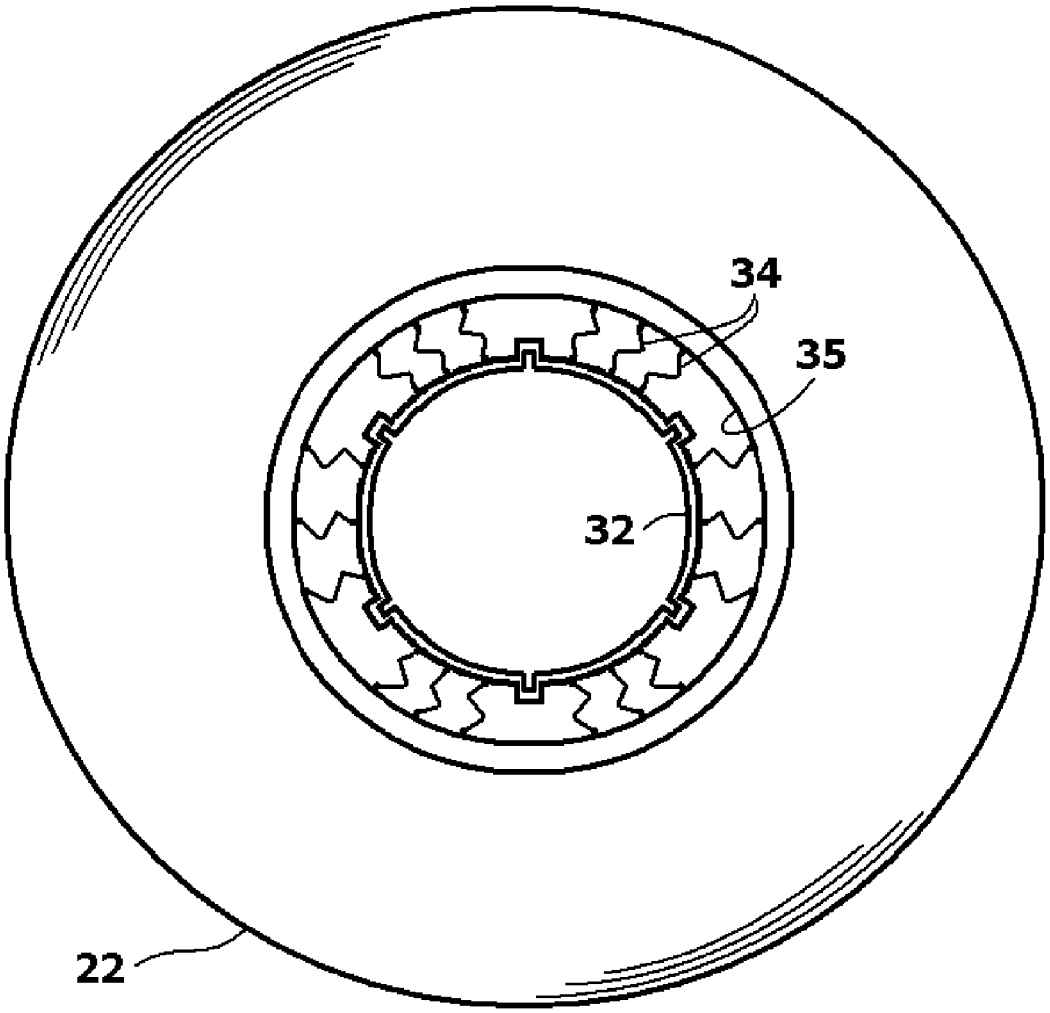
FIG. 3 is a top view of the annular disc body used within the flying disc assembly.

Referring to FIG. 3 in conjunction with FIG. 2, it can be seen that a mounting ring 32 is disposed in the central opening 24 of the flying disc assembly 10. The mounting ring 32 extends in the same plane as the central opening 24 and is symmetrically positioned within the central opening 24. A plurality of shock absorbing elements 34 surround the mounting ring 32. The shock absorbing elements 34 interconnect the mounting ring 32 to the edge 35 that defines the central opening 24. The shock absorbing elements 34 can be any structure that can elastically deform under both tension and compression. As such, the shock absorbing elements 34 can be springs, segments of elastomeric material or a webbing of elastic string. In FIG. 2 and FIG. 3, the shock absorbing elements 34 are serpentine lengths of plastic 36 that interconnect the mounting ring 32 to the annular disc body 22. In this manner, the mounting ring 32 and the shock absorbing elements 34 can be integrally molded with the annular disc body 22 as a single piece.

Figure 4:
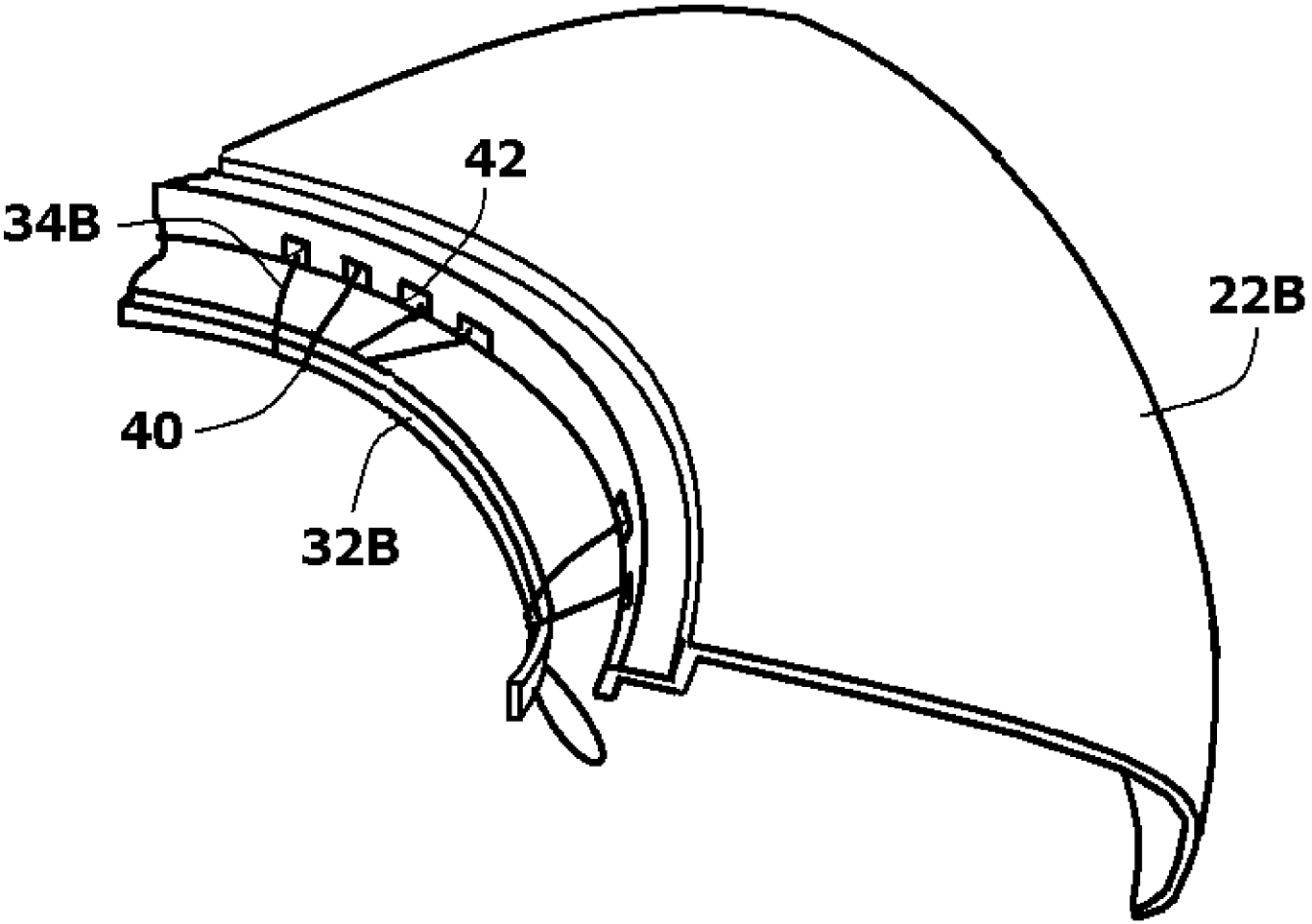
FIG. 4 is an enlarged fragmented view showing an alternate configuration for the shock absorbing elements.

Referring briefly to FIG. 4, an alternate embodiment for the shock absorbing elements 34B is shown. In this embodiment, the shock absorbing elements 34B are a plurality of O-rings 40 that are stretched around the mounting ring 32B and through slots 42 on the annular disc body 22B.

Figure 5:
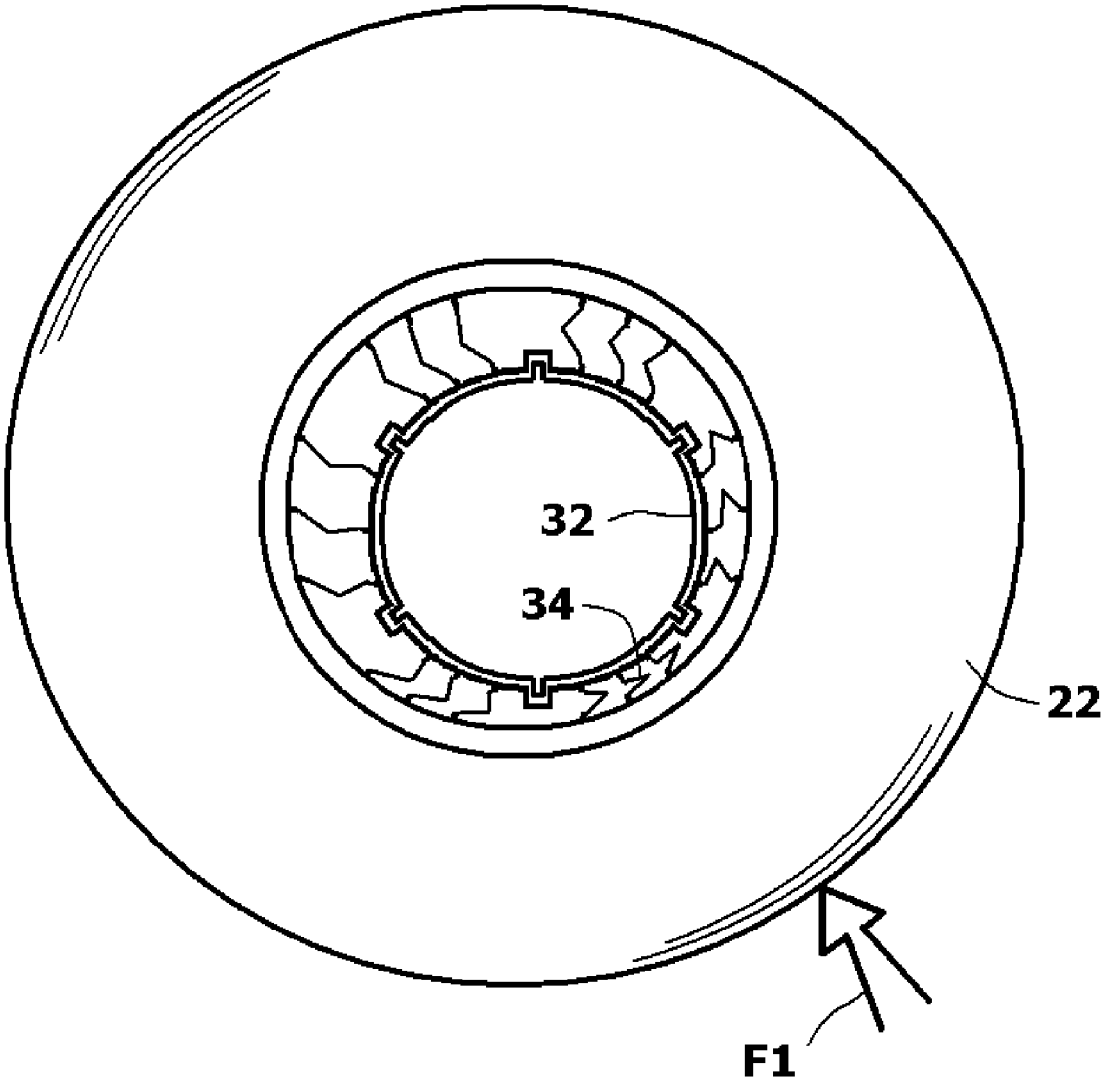
FIG. 5 is a top view of the annular disc body used within the flying disc assembly shown in conjunction with an impacting force.

Returning to FIG. 2 and FIG. 3, it will be understood that regardless of the structure selected for the shock absorbing elements 34, the presence of the shock absorbing elements 34 centers the mounting ring 32 within the central opening 24. Furthermore, the presence of the shock absorbing elements 34 enables the mounting ring 32 to resiliently move within the central opening 24 when an impacting force is experienced by the flying disc assembly 10. An example is shown in FIG. 5. Referring to FIG. 5 in conjunction with FIG. 3, it can be seen that when a force F1 is experienced in any direction, the mounting ring 32 will move within the central opening 24 in response to that force F1. The impacting force F1 causes some of the shock absorbing elements 34 to compress. The impacting force F1 also causes some of the shock absorbing elements 34 to stretch. All of the shock absorbing elements 34 deform in some manner in resistance to the applied force F1. As such, the impacting force F1 is distributed among all the shock absorbing elements 34, wherein the applied force F1 is at least partially absorbed. Furthermore, some of the applied impacting force F1 is absorbed by the annular disc body 22, which may also temporarily deform. The result is that the force experienced within the mounting ring 32 is greatly diminished from the impacting force F1 striking the annular disc body 22.

Returning to FIG. 2 and FIG. 3, it will be understood that the electronics module 12 mounts to the mounting ring 32 and moves with the mounting ring 32 relative the annular disc body 22. The electronics module 12 has an upper housing 46 and a lower housing 48 that mount together on opposite sides of the mounting ring 32 using mechanical connectors. Accordingly, when assembled, the mounting ring 32 is interposed between the upper housing 46 and the lower housing 48. The upper housing 46 has a circular flange 50. The circular flange 50 has a diameter D4. The diameter D4 of the circular flange 50 is between 15% and 25% smaller than the diameter D3 of the circular ridge 28 formed on the annular disc body 22.

Figure 6:
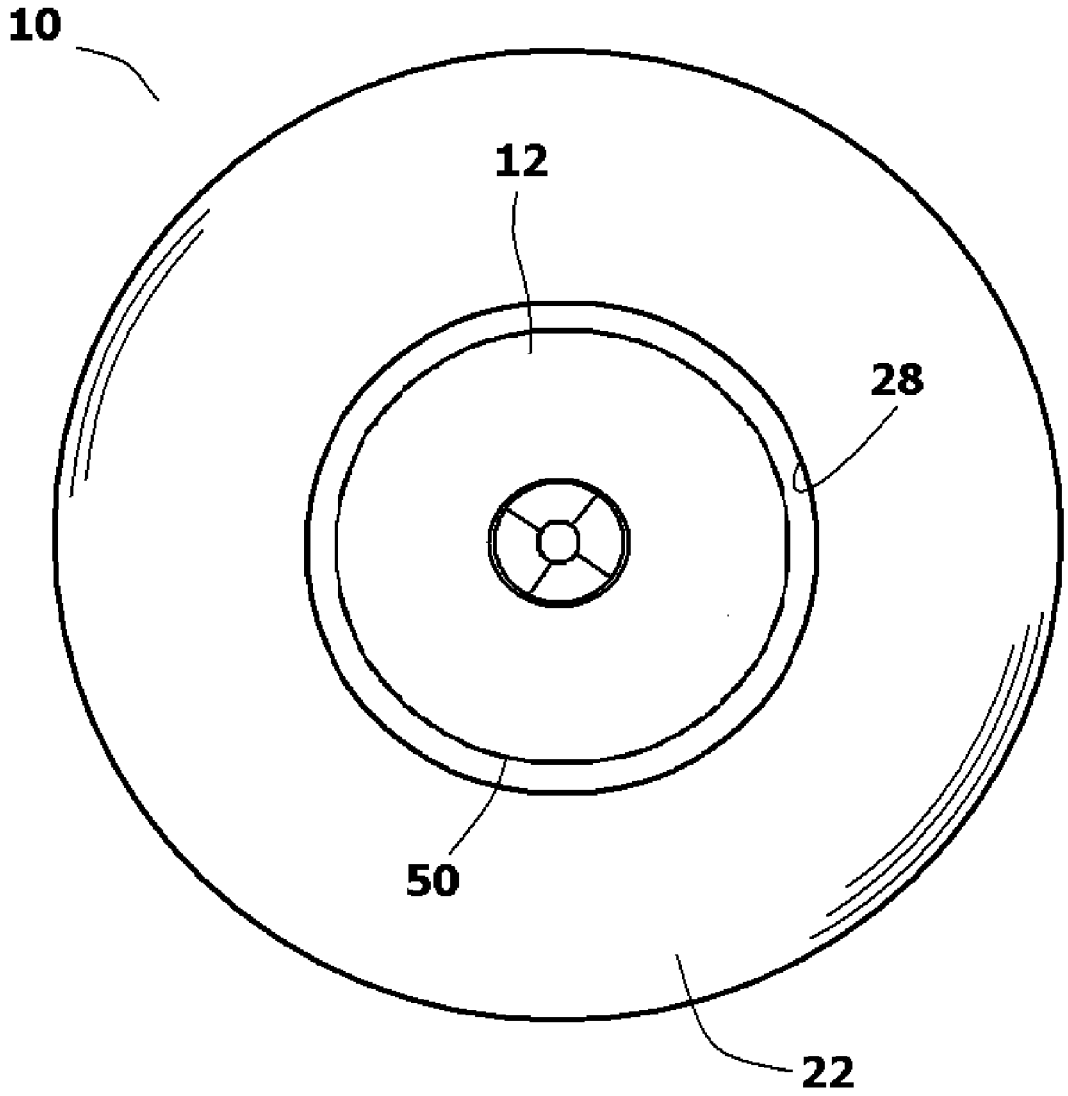
FIG. 6 is a top view of the flying disc assembly.
Figure 7:
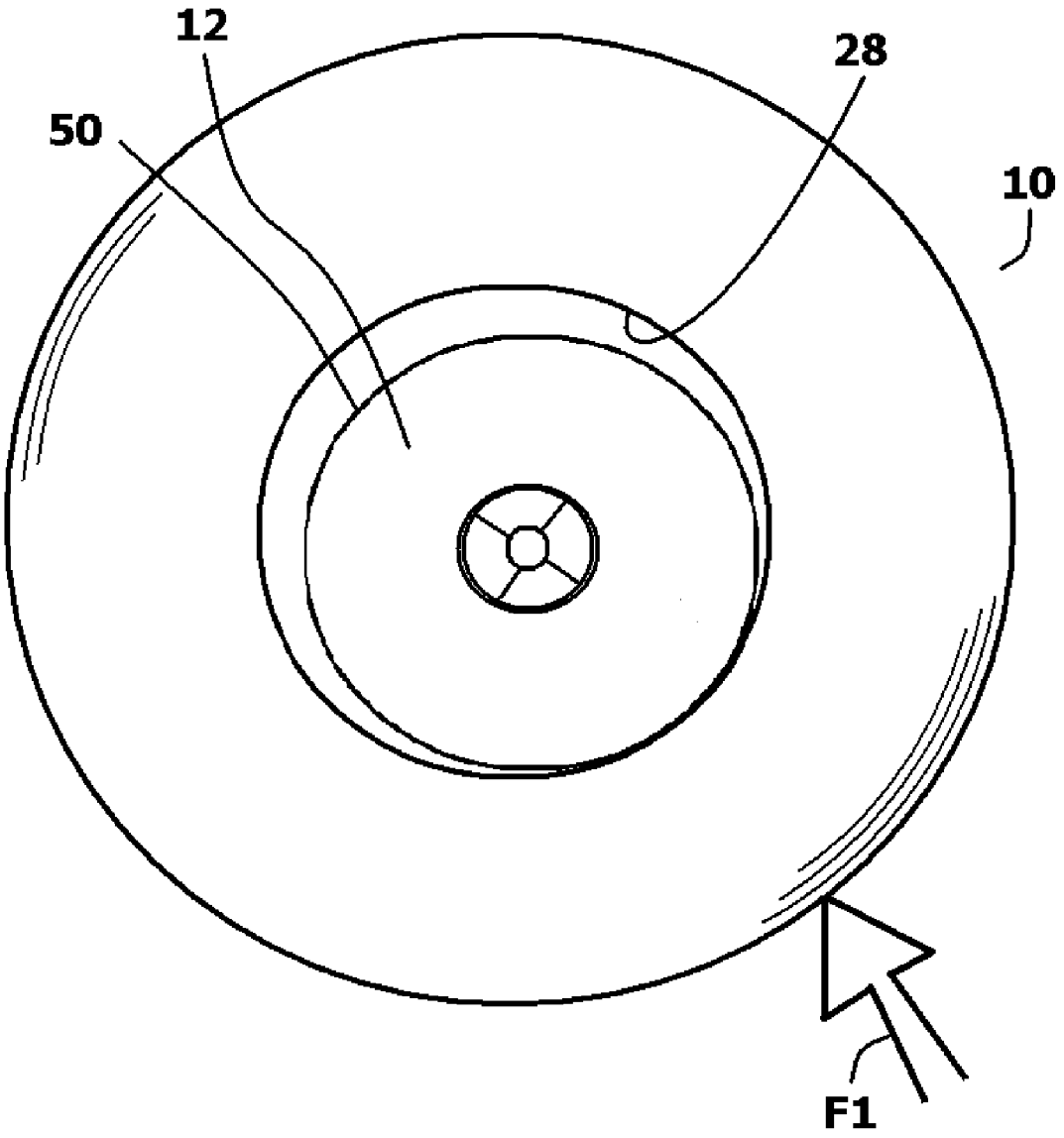
FIG. 7 is a top view of the flying disc assembly shown in conjunction with an impacting force.

When assembled, the circular flange 50 is disposed within the perimeter of the circular ridge 28. Referring to FIG. 6 and FIG. 7 in conjunction with FIG. 2, it can be seen that the circular flange 50 acts as a limit stop to the movements of the electronics module 12 and the mounting ring 32 within the electronics module 12. When the flying disc assembly 10 experiences an impacting force F1, the mounting ring 32 moves. The electronics module 12 moves with the mounting ring 32. The circular flange 50 limits the range of movement. If the impacting force F1 is great enough, the circular flange 50 on the electronics module 12 will contact the circular ridge 28 and the relative movement of the electronics module 12 will stop relative to the annular disc body 22. This acts as a safety to prevent the shock absorbing elements 34 from being over extended and permanently deformed. Accordingly, the electronics module 12 and the mounting ring 32 can move together within the central opening 24 within a preset range. The range is limited by the contact of the circular flange 50 on the electronics module 12 with the circular ridge 28 on the annular disc body 22.

Returning to FIG. 1 and FIG. 2, it will be understood that the upper housing 46, the lower housing 48 and the mounting ring 32 define an enclosed chamber 52 when assembled. A circuit board 54 is mounted within the enclosed chamber 52. The circuit board 54 contains a receiver, and circuitry that enables the circuit board 54 to receive wirelesses data transmissions 14 using Bloothtooth® transmission protocols or a similar wireless transmission system. The circuitry may also include a storage memory that enables the assembly to store received transmissions for later broadcast. The circuit board 54 has a top surface 56 that faces the upper housing 46 and a bottom surface 58 that faces the lower housing 48. Controls 60 for the circuit board 54 are positioned on the top surface 56 of the circuit board 54. The controls 60 include volume controls, play controls, pause controls and an on/off switch. The controls 60 are accessed using a user interface pad 62 that is positioned above the circuit board 54. The user interface pad 62 is accessed through a control port 65 in the center of the upper housing 46. By pressing different areas of the user interface pad 62, various functions programmed into the circuit board 54 can be selectively activated and deactivated.

One or more speakers 64 are mounted to the bottom surface 58 of the circuit board 54. The speakers 64 face the lower housing 48. Perforations 66 are disposed in the lower housing 48 so that audio from the speakers 64 can be perceived outside of the flying disc assembly 10.

Segments of adhesive padding 68 are also provided. The segments of adhesive padding 68 are disposed between the mounting ring 32 and the subassembly of the upper housing 46 and lower housing 48. The pads help retain the connection of the upper housing 46 and the lower housing 48 to the mounting ring 32. The adhesive padding 68 also helps absorb some of the acceleration forces experienced by the components within the enclosed chamber 52.

The flying disc assembly 10 is prepared for use by either inserting or recharging the batteries 20. The flying disc assembly 10 is then synced with a mobile computing device 16, such as a cell phone. This enables the flying disc assembly 10 to receive wireless data transmissions 14 from the mobile computing device 16. The flying disc assembly 10 is then activated using the user interface pad 62.

As the flying disc assembly 10 receives wireless data transmissions 14, the flying disc assembly 10 converts the wireless data transmissions 14 into audio signals 18 and broadcasts the audio signals 18 from the speakers 64 in real time. The volume of the broadcast can be controlled using the user interface pad 62. Accordingly, a person can adjust the volume of the audio transmission when holding the flying disc assembly 10. Furthermore, the audio transmission can be selectively stopped or started on the flying disc assembly 10 using the user interface pad 62.

The flying disc assembly 10 is thrown and caught in a traditional manner. If activated, the flying disc assembly 10 will continuously broadcast music or other audio signals 18 while being thrown or caught. Once caught, a user can start or stop the music. The user can also adjust the volume of the music being played.

The audio broadcast is directed out of the bottom of the lower housing 48. Accordingly, the annular disc body 22 acts as an audio reflector that reflects sound in a particular direction. In this manner, even if the flying disc assembly 10 is stationary on a table or chair, the flying disc assembly 10 can be oriented to broadcast the audio signals in a particular direction.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A flying disc assembly comprising:

an annular disc body that defines a central opening;

an electronics module;

a mounting ring disposed within said central opening that receives and retains said electronics module; and deformable plastic elements that span between said annular disc body and said mounting ring, wherein said deformable plastic elements are integrally molded as part of both said annular disc body and said mounting ring, wherein said deformable plastic elements enable said mounting ring and said electronics module to move relative said annular disc body when said flying disc assembly experiences a rapid change in velocity.

2. The assembly according to claim 1, wherein said electronics module is mechanically affixed to said mounting ring.

3. The assembly according to claim 2, wherein said deformable plastic elements are serpentine lengths of plastic that span between said annular disc body and said mounting ring and interconnect the mounting ring to the annular disc body.

4. The assembly according to claim 3, wherein said annular disc body, said deformable plastic elements and said mounting ring are integrally molded together as a single piece.

5. The assembly according to claim 1, wherein said electronics module is limited to range of movement relative said annular disc body by contact with said annular disc body.

6. The assembly according to claim 1, wherein said electronics module has a circular flange that is disposed within said central opening, wherein said circular flange contacts said annular disc body should said electronics module move relative said annular disc body outside of a predetermined range.

7. The assembly according to claim 1, wherein said electronics module broadcasts audio signals.

8. The assembly according to claim 1, wherein said electronics module streams audio that is wirelessly transmitted from a remote source.

9. The assembly according to claim 7, wherein said electronics module has volume controls for adjusting a volume associated with said audio signals being broadcast.

10. A flying disc assembly comprising:

an annular disc body that defines a central opening;

an electronics module that extends into said central opening;

a plurality of serpentine plastic elements that radially extend into said central opening from said annular disc body, wherein said electronics module is supported by said plurality of serpentine plastic elements and is able to move within said central opening, relative said annular disc body, through a range of movement by elastically deforming said plurality of serpentine plastic elements.

11. The assembly according to claim 10, wherein said plurality of serpentine plastic elements elastically deform when said flying disc assembly experiences a rapid change in velocity.

12. The assembly according to claim 11, further including a mounting ring disposed within said central opening, wherein said mounting ring is attached to said plurality of serpentine plastic elements and said electronics module is coupled to said mounting ring.

13. The assembly according to claim 12, wherein said annular disc body, said plurality of serpentine plastic elements and said mounting ring are integrally molded together as a single piece.

14. The assembly according to claim 10, wherein said electronics module has a circular flange that is disposed within said central opening, wherein said circular flange contacts said annular disc body should said electronics module move relative said annular disc body outside of said range of movement.

15. The assembly according to claim 10, wherein said electronics module broadcasts audio signals.

16. The assembly according to claim 10, wherein said electronics module streams audio that is wirelessly transmitted from a remote source.

17. The assembly according to claim 16, wherein said electronics module has volume controls for adjusting a volume associated with said audio being broadcast.

18. A flying disc assembly comprising:

an annular disc body that defines a central opening;

an electronics module;

a mounting ring disposed within said central opening that receives and retains said electronics module; and elastic bands that span between said annular disc body and said mounting ring, wherein said elastic bands enable said mounting ring and said electronics module to move relative said annular disc body when said flying disc assembly experiences a rapid change in velocity.

* * * * *